US005925859A

United States Patent [19]

Miller et al.

[11] Patent Number: 5,925,859

[45] Date of Patent: Jul. 20, 1999

[54] LANDING CONTROL SYSTEM

[75] Inventors: George Miller, Massapequa; Michael Miller, Babylon, both of N.Y.

[73] Assignee: Interface Products Co., Inc., Bayshore, N.Y.

[21] Appl. No.: 08/906,786

[22] Filed: Aug. 6, 1997

[51] Int. Cl.[6] ..... B66B 1/36; B66B 1/34

[52] U.S. Cl. ..... 187/394; 187/391; 187/283

[58] Field of Search ..... 187/394, 283, 187/282, 393, 391, 399, 414, 409

[56] References Cited

U.S. PATENT DOCUMENTS

| | | | |
|---|---|---|---|
| 3,889,231 | 6/1975 | Tosato et al. | 340/21 |
| 4,674,603 | 6/1987 | Estrella | 187/394 |
| 4,798,267 | 1/1989 | Foster et al. | 187/394 |
| 5,360,085 | 11/1994 | Yoo et al. | 187/406 |
| 5,594,219 | 1/1997 | Kamani et al. | 187/394 |
| 5,798,490 | 8/1998 | Vairo et al. | 187/394 |

FOREIGN PATENT DOCUMENTS

| | | | |
|---|---|---|---|
| 245757 | 3/1966 | Austria | 187/294 |

*Primary Examiner*—Robert E. Nappi
*Attorney, Agent, or Firm*—Bauer & Schaffer, LLP

[57] ABSTRACT

A landing control system comprising an elongated nonmagnetic strip extending vertically along the length of the shaft, having along its length, at predetermined sites, magnetic adhesive tape containing coded information. A sensor for reading the coded information is mounted on the exterior of the elevator car grasping the nonmagnetic strip by a pair of tape guides, the guides being spaced as to permit the centrally located magnetic adhesive tape to pass freely into the sensing area without, while avoiding contact with the tape.

10 Claims, 4 Drawing Sheets

20
32
26
30
12
16
56
49
44
18
54
53
50
46
48
40
36
34
28
38
42a
42b
42

LANDING CONTROL SYSTEM

BACKGROUND OF THE INVENTION

The present invention relates to a landing control system suitable for controlling the operation of a lift or elevator.

One of the most significant operational problems arising in high use multi-story elevator installations concerns the landing control system by which the elevator makes an appropriate and specific stop at the floor or landing selected by the user. As is known, the elevator car is lifted and lowered through a shaft by a hoist mechanism as it rides on continuous vertical rails constituting a hoist way. Various landing systems have been applied to such basic structure to arrest the car movement at selected floors.

In U.S. Pat. No. 2,674,348 to Santini et. al., an elevator system is disclosed in which inductor plates mounted along the elevator shaft are detected by sensors mounted on the elevator to initiate deceleration and leveling. A major disadvantage of this system is that it requires very close tolerances in order to insure proper alignment. These close tolerances make maintenance of the system difficult and costly. In addition, alteration of the system is complex, requiring the system to be shut down for long periods.

U.S. Pat. No. 2,840,188 to Savage discloses a system in which magnetic plates are mounted on a nonmagnetic ribbon which extends the length of the elevator shaft. Although this system makes maintenance somewhat easier, the removal and replacement of the magnetic plates remains costly. Again, alteration requires lengthy downtime at a significant cost to the user.

In U.S. Pat. No. 4,203,506 to Richmon an elevator control system is disclosed in which a magnetic target material is wrapped around a nonmagnetic wire. The magnetic target material triggers a sensor contained within the sensor housing. A major disadvantage of this system is the frictional wear inflicted upon the magnetic material due to the repetitive contact of the housing. This wear necessitates the replacement the magnetic target material, which can be costly, requiring the uncrimping of the soft metal target material. This can be a tedious and time consuming process, making the system particularly unsuited to on-site alteration.

It is, therefore, the object of the present invention to provide a landing control system that is accurate in its deceleration and stopping. It is a further object of the present invention to provide a system that minimizes wear on the rail and/or car and allows for simple on-site alteration, reconstruction and repair.

These objects, as well as others, will be apparent from the following disclosure of the present invention.

SUMMARY OF THE INVENTION

According to the present invention, a landing control system for the control of an elevator or lift is provided comprising a non-magnetic elongated strip extending vertically along the length of a hoistway, having along its length a magnet with alternating magnetic poles; magnetically encoded adhesive tape portions are provided at predetermined points along the strip, the tape portions having a verification function and other operational control functions; and sensing means for counting the magnetic poles and for reading the magnetically encoded tape portions.

In accordance with the present invention, tape portions having magnetic code thereon are provided at predetermined sites along the non-magnetic strip. Each tape portion is provided with data necessary to initiate a plurality of operational functions.

In accordance with the principles of this invention, sensing means is provided for counting the alternating poles and for reading the encoded tape portions. The sensing means is configured such that it can detect not only the number of poles but direction of the elevator. The sensing means also reads the tape portions to initiate a plurality of operational functions such as deceleration, leveling and stopping.

Each predetermined site at which the coded magnetic tape is secured to the nonmagnetic strip corresponds to the position at which it is intended to have the car make an accurate and level landing at the floor. The position of the coded magnetic tape may, thus, be at the floor level, below the floor level or above the floor level since stopping or arresting movement of the car is a function of the operating system as the car moves up and down. Generally, a magnetic strip may be placed between floors and coded with indicia signifying each floor respectively on each of the up or down movement of the car. The coded tape may, thus, selectively have plural functions and may be placed as selected by the user.

As a result of this unique configuration, the presently disclosed landing control system provides a simple and reliable system for controlling an elevator or lift. Furthermore, this system is relatively maintenance free and allows the user to easily alter the system with minimal downtime and cost. In addition, the present invention allows for verification that the lift or elevator has stopped at the appropriate location.

Full details of the present invention are set forth in the following description and shown in the accompanying drawings.

DETAILED DESCRIPTION OF THE INVENTION

Figure 1:
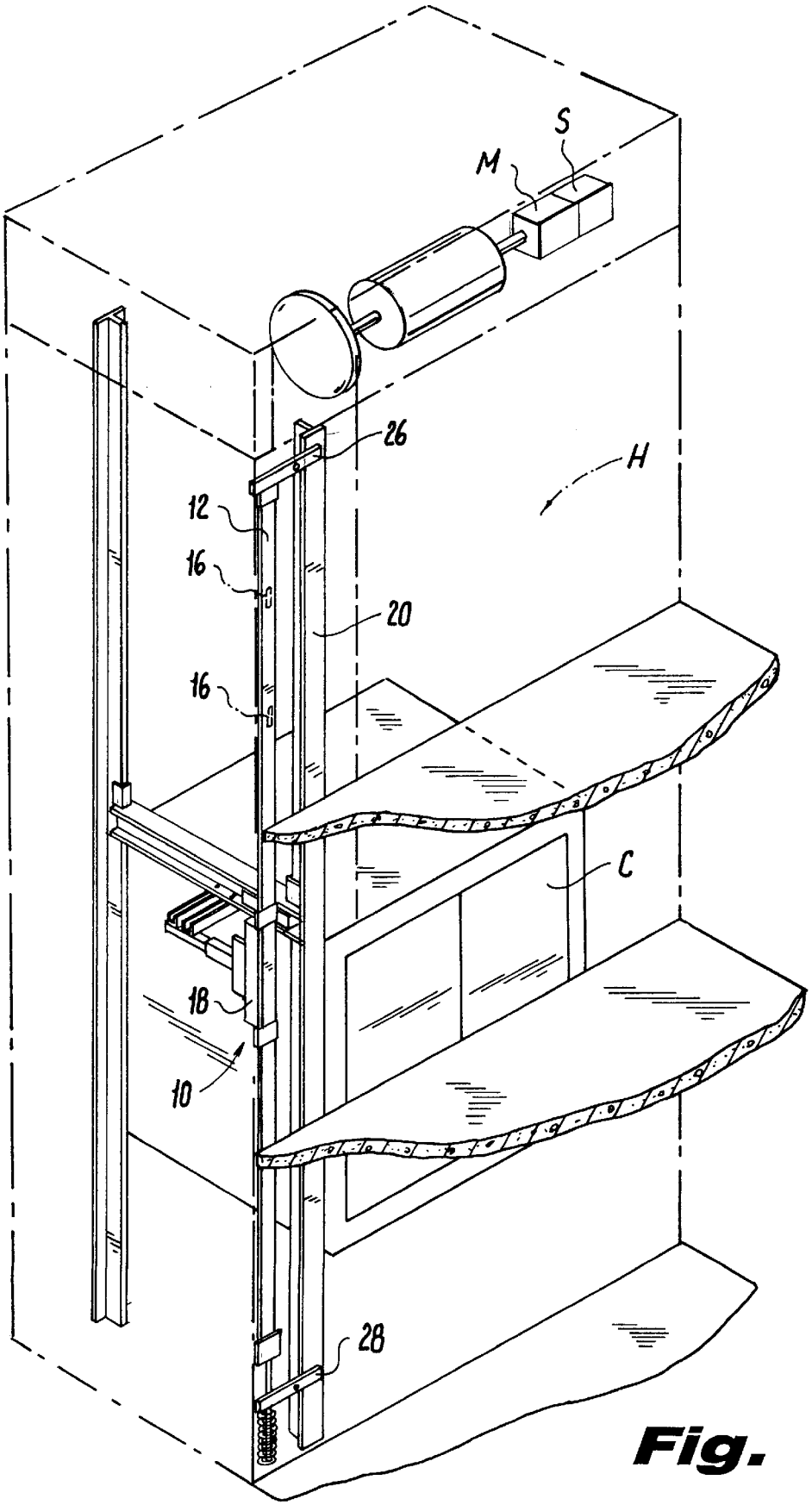
FIG. 1 is an isometric view of the landing control system installed in a hoistway.

In FIG. 1 an elevator system is shown. The system, as is conventional is located in vertical hoistway or shaft H having a plurality of guiderails on which a cab C for passengers or freight rides. The cab C is lifted by an electric motor M controlled by a computerized control unit S receiving information as to the destination, speed and other operational factors by a landing control system generally depicted by the numeral 10.

The landing control system 10 comprises a nonmagnetic strip 12, the strip 12 having along its length, adjacent one edge, a continuous magnet assembly 14 with a plurality of alternating poles, and along its other edge a plurality of discrete and spaced magnetically encoded tape portions 16 one each located at predetermined sites along the strip 12. A sensing assembly 18, in mounted to move conjointly with the cab C, rides over the nonmagnetic strip, and is provided with sensing heads to read the magnet assembly and the discrete tape portions, respectively. Both the magnet assembly 14 and the encoded tape are removably attached to the strip 12, as by providing each of the back surface with adhesive.

The nonmagnetic strip 12 extends the length of the hoistway H and is mounted at the top and bottom of the hoistway to guiderail 20 by upper clamp means 26 and lower clamp means 28, so as to be tightly stretched in place but easily removable. Preferably, the nonmagnetic strip 12 is located to extend away from the guiderail 20 into the space between the cab C and side wall of the hoistway H. In this manner, the tape is free of contact with both the rail and the car. Where space between the side wall and car does not permit, the tape may be placed elsewhere, where convenient.

Figure 2:
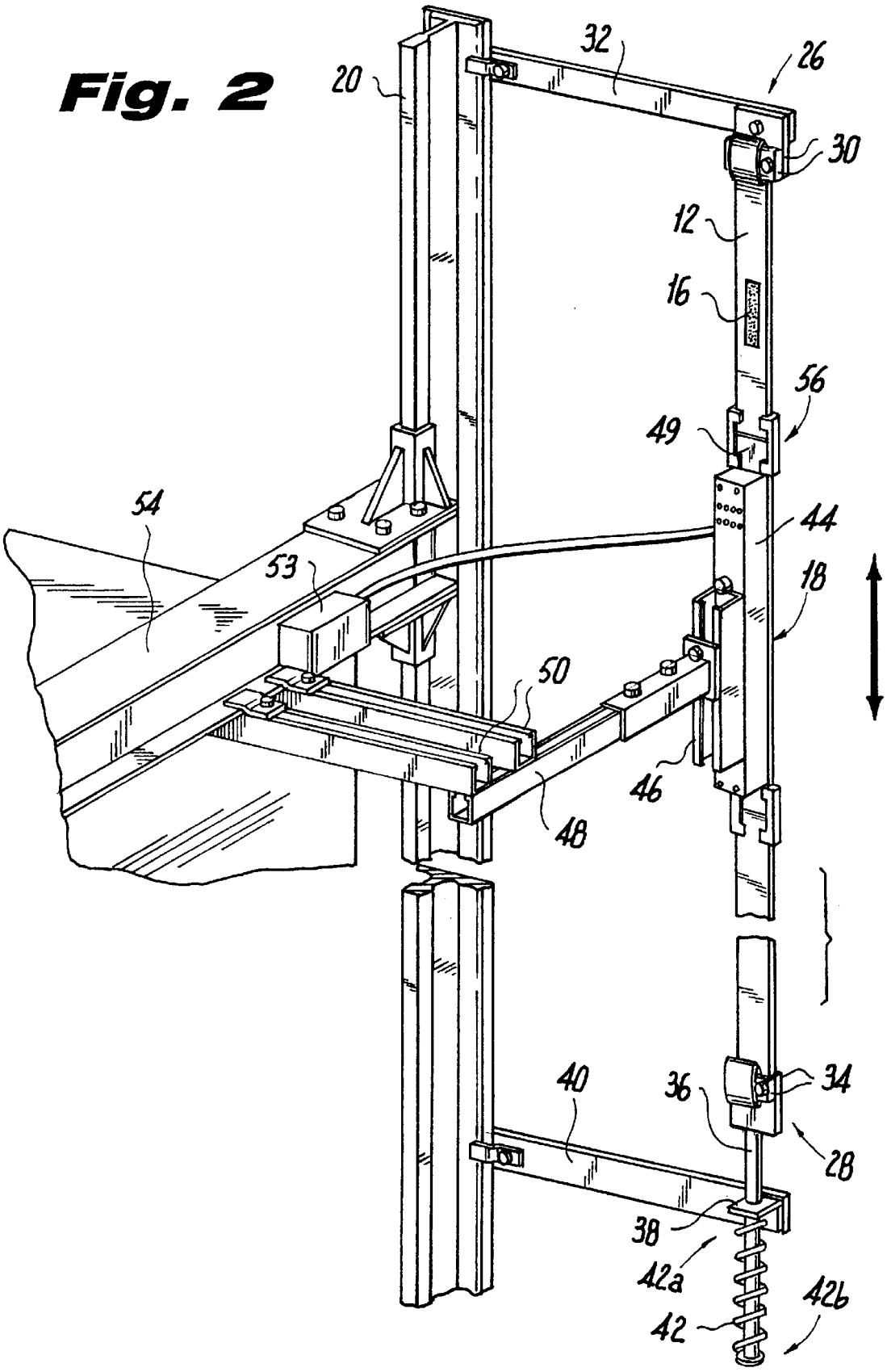
FIG. 2 is an isometric view of the landing control system.

As seen in FIG. 2, the upper clamp means 26 comprises a pair of clamp plates 30 secured to connecting arm 32 which in turn is mounted to guiderail 20. The lower clamp means 28 comprises a pair of clamp plates 34 to which is fixedly mounted a depending rod 36 which passes freely through a bracket 38 fixed at the end of a connecting arm 40. Connecting arm 40 is secured to the guiderail 20 at the base of the hoistway. Depending rod 36 is supplied with a compression spring 42 bearing at its upper end 42*a* against the bracket 38 and tied with suitable fastener means securely at its lower end 42*b* to the rod 36. In this manner, the rod 36 and nonmagnetic tape 12 is pulled taut so as to absorb any vibration caused by the movement of the car or the sensing head 18.

It is preferable that nonmagnetic strip 12 be manufactured from a durable material such as steel or stainless steel. In addition, the strip should be between 2" and 4" in width to maximize workability and to provide room for both the magnet assembly and the discrete magnetically encoded tape portions.

As seen in FIG. 2, magnetically encoded tape portion 16, preferably comprising a length of about six to twelve inches of a plastic strip and having self-adhering adhesive on its back is affixed to the nonmagnetic strip 12 at strategically selected points associated with the respective landings to provide suitable codes for the initiation of the deceleration leveling of the elevator and landing of the cab C. It is critical that the magnetic tapes be aligned with each other to minimize sensing head hunting or skew.

The magnet assembly 14 extending without blocks, along the length of the strip 12, is provided with alternating poles of positive and negative polarity. The magnet assembly 14 extends the length of the hoistway allowing the sensing head 18 to count, from an initial starting number, the magnetic poles in ascending order as the elevator travels up the hoistway and descending order as the elevator travels down the hoistway. When the magnetic count equals a predetermined number an output signal is produced. This signal initiates the sensing of the encoded tape portion 16.

Each magnetic tape portion 16 is suitably encoded with information which can be read by sensing assembly 18 producing a signal to control the operation of the lift. Each tape portion 16 is provided with fixed code corresponding to a particular floor as well a verification portion to verify the floor and the poles counted from magnet assembly 14. Once verified each tape portion 16 has a leveling function that is encoded with data to control the deceleration, leveling of the lift, and such other functions as opening the cab door. Additional tape sections may easily be added to alter or modify the signals to be sensed. In this way, modifications can be made on site with minimal downtime and maintenance.

The sensing assembly 18, preferable a model IP-8300 sensor, manufactured by Interface Products 115 N. Fehr Way, Bayshore, N.Y. 11706, contains a plurality of sensor heads arranged to read the poles in the magnet assembly 14 and the encoding placed on the tape portions 16. The sensing assembly 18, has a plurality of heads, two of which, arranged orthognally to each other, are located opposite the elongate magnet assembly 14. As the heads are perpendicular to each other, they not only sense the pulse as they pass from the negative to the positive poles, but they also sense the direction of travel, i.e. ascending or descending. In addition a plurality, preferably four sensing heads are arranged relative to each other and in a position to read the encoded tape 16. By use of four heads each reading a different aspect of the encryption, a signal containing at least 16 bits of information can be obtained. Thus, the output of the encoded tape portions can provide a signal to control a plurality of functions.

The sensing heads are housed in a box 44 mounted to a bracket 46. The box 48 and the bracket 46 are held together by a pair of roller bearings 45 and 45 at the upper and lower edges of the bracket. This enables a relatively small degree of movement between the box and the bracket. The bracket is fixed at its free end to a two piece telescoping arm 48 the length of which may be adjusted. The free end of the telescoping arm is secured to a pair of transverse beams 50 which are fixedly secured a ceiling beam 54 of the cab C so as to be conjointly movable therewith. In this manner, the sensing assembly 18 can be held fixed in vertical orientation with its longitudinal face parallel to and spaced from the face of the nonmagnetic strip 12.

The sensing assembly 18 is powered from a power supply source 53 mounted to ceiling beam 54 of the cab C. The power supply box draws its power from the conventional elevator power supply system.

Figures 3, 4:
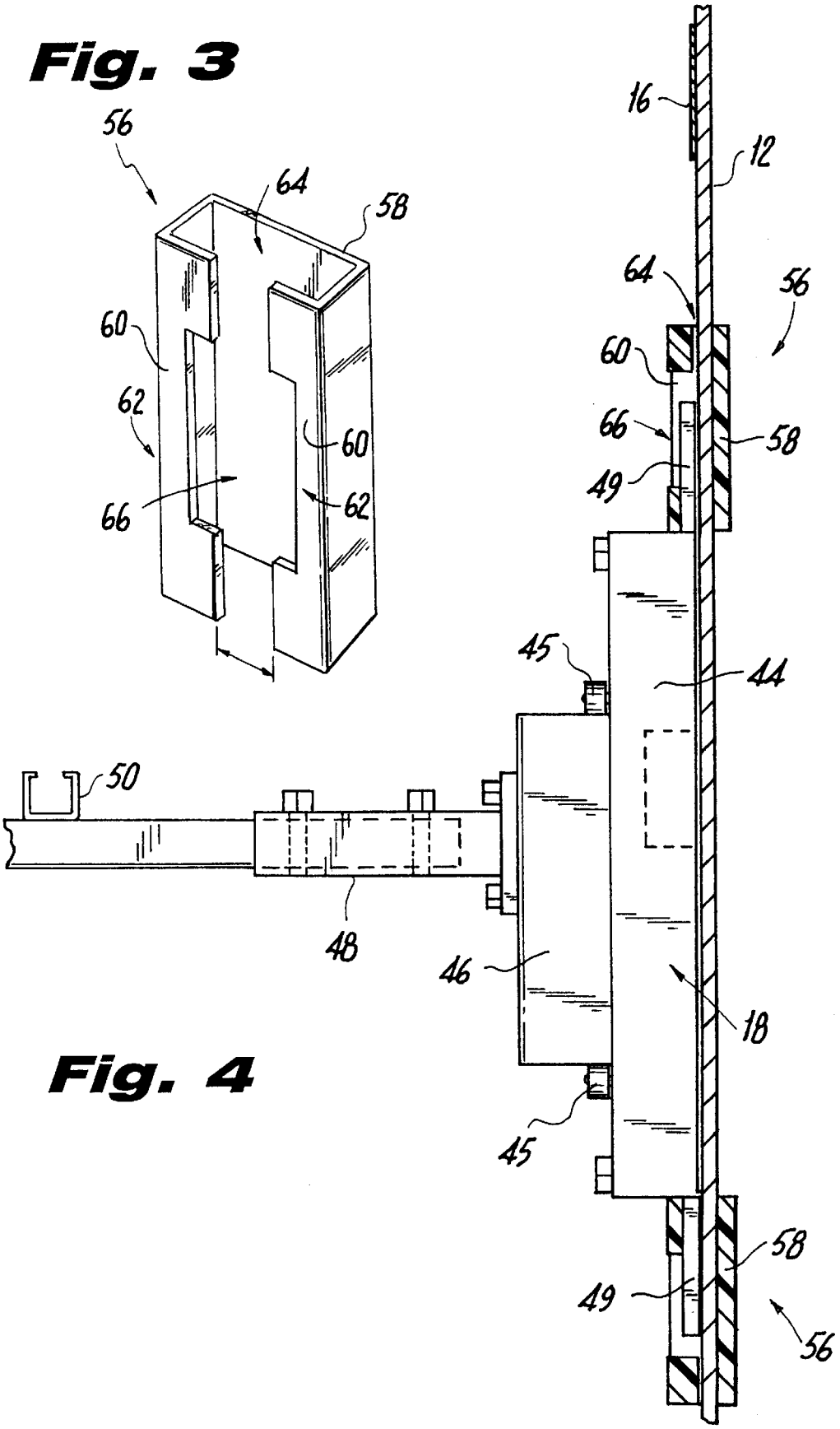
FIG. 3 is a side view of the landing control system.
FIG. 4 is an enlarged view of the tape guide.
Figure 5:
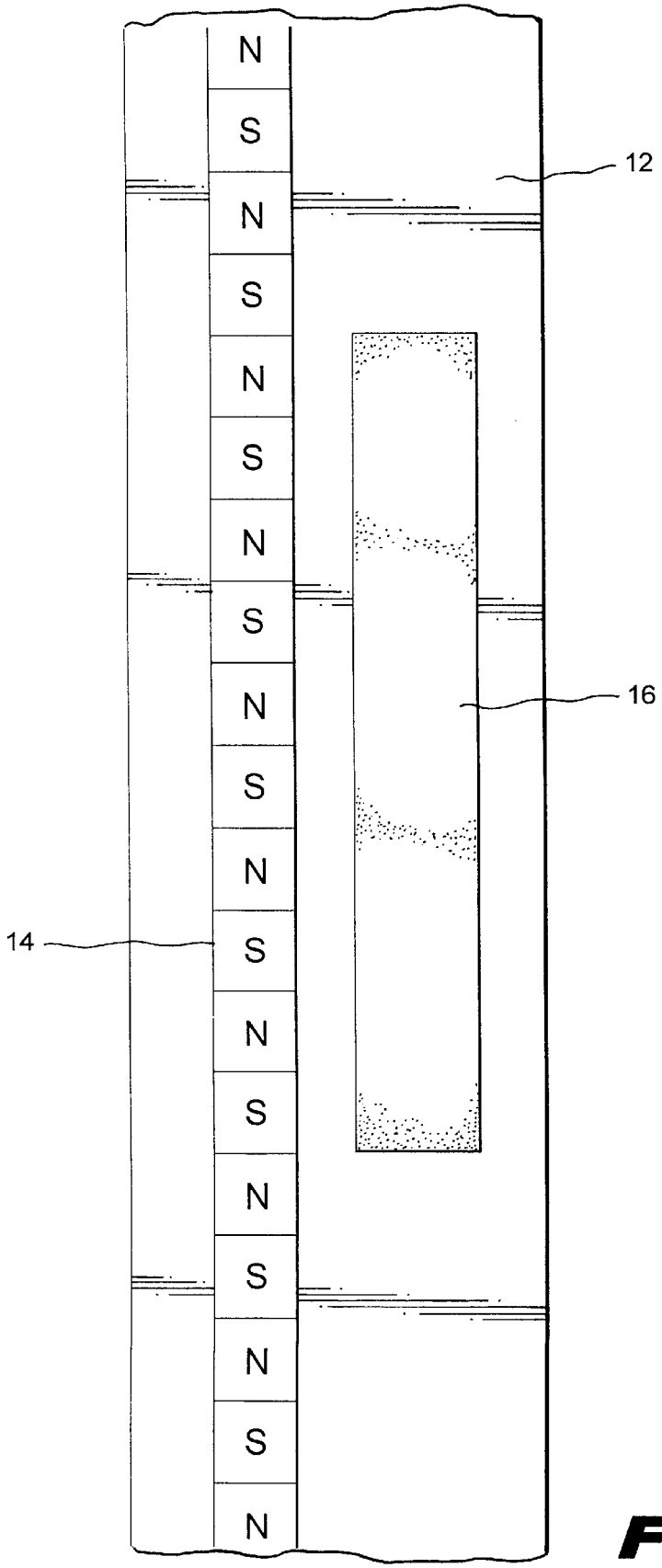
FIG. 5 is a front view of the nonmagnetic tape including the magnet assembly and a tape portion.

Fixed to the upper and lower edges of box 48, housing the sensor assembly, are guides 56 which act to guide the sensing assembly relative to the nonmagnetic strip 12 as the sensor assembly rides over the strip 12. As seen in detail in FIG. 4, each guide 56 comprises a unitary flat bracket having a rear wall 58 and opposed side edges 60 folded over to provide a U-shaped hem 62 along each side. The hem 62 defines a slit 64 into which the edge of the nonmagnetic strip fits. The side hems 62 are spaced apart to leave a window 66 allowing the sensors free access to the encoded information. The guides 56 are constructed such that they permit the magnet assembly 14 and magnetic tape portions 16 to pass without any interference between the hems 62 and yet be fully visible in the window provided between the hem 62. This unique construction all but eliminates the frictional wear generally associated with similar systems. It is preferable that guides 56 be constructed of a non-abrasive material such as nylon to minimize wear on nonmagnetic strip 12.

In operation, the above described landing control system functions in the following manner. A user presses a button on a control panel contained in the elevator cab corresponding to a particular floor or the call button in the hallway to call the cab. An electric signal is sent to the conventional operational control unit S of the elevator. The signal received by the operational control unit includes a directional sector to cause the cab C to ascend or descend from its last position, the magnetic pulse count at the selected floor, and the pulse count from the initial floor, so that the operation control unit can count the difference in pulses from the initial to the selected floor as the cab moves.

For example, if the user is on the ground floor and wishes to travel to the fourth floor a signal corresponding to the difference in the number of magnetic poles between the floors is transmitted to the operational control units. The operational control units receives this information, and sends a signal to the motor M to begin raising the elevator cab C. As the elevator cab C travels up the hoistway H, the magnetic sensors count the number of magnetic poles and transmits the count to the operational control units. As the elevator nears the appropriate count, the sensor assembly passes over the strategically located magnetic tape 16. The sensors verify the count obtained from the magnet assembly, verifies the floor and if correct sends a signal to the motor M to decelerate the elevator car and properly level the car at its landing.

The control unit, its operation in acceleration, deceleration and landing contains computer structure and functions which are conventional, and available from commercial sources, and need not be more fully disclosed herein.

The unique configuration described above renders the landing control system relatively maintenance free. It should be noted however, if for some reason the adhesive magnetic tape 16 or the magnet assembly 14 must be replaced it is simply a matter of removing the tape or assembly and replacing it. Furthermore, if additional stopping points are required along the hoistway, subsequent tape portions can be secured along the nonmagnetic strip. If the tape supporting strip 12 must be replaced, it to is easily removed from its brackets. This unique configuration allows the system to be easily altered on site with minimal downtime and cost. In addition, the above system allows the elevator stopping location to be verified so as to insure an accurate stopping point every time.

Various modifications and changes have been disclosed herein, and others will be apparent to those skilled in this art. Therefore, it is to be understood that the present disclosure is by way of illustration and not limiting of the present invention.

What is claimed is:

1. In a multi-storied elevator system, wherein the cab is movable up and down along fixed rails in a vertical shaft and is capable of being selectively stopped at intermediate landings by an electrically operated control system, a landing control system comprising an elongated strip of nonmagnetic material extending substantially from the bottom of the shaft to the top thereof, secured to the face of said strip is a continuous magnet assembly having alternating poles extending the length of said strip, and a plurality of discrete magnetically encoded tapes sequentially spaced along the length of the strip, said landing control system having magnetic sensor means mounted on said elevator cab into spaced proximity with said strip to count said alternating poles and to detect and decode the magnetically encoded tapes as it moves up and down in said shaft, said sensor means providing electrical signals for said elevator control system.

2. The landing control system, according to claim 1, wherein the removable encoded tape comprises a plastic tape on which is magnetically located encoded information adhesively attached to said strip.

3. The landing control system according to claim 1, wherein said continuous magnet assembly is adhesively attached to said strip.

4. The landing control system according to claim 1, wherein said sensor means comprises a pair of orthognally oriented sensing heads located in opposition to said continuous magnetic assembly so as to read the magnetic pulses and directions of movement.

5. The landing control system, according to claim 3, wherein the discrete encoded tapes are horizontally aligned with respect to their associated landing and spaced therefrom so as to be read in advance of said landing.

6. The landing control system according to claim 1, wherein said elongated nonmagnetic strip is fixedly secured at one end by a bracket extending cantilevered from said rail and at its other end by a bracket extending cantilevered from said rail provided with a spring means biasing said strip, maintaining the strip substantially taut.

7. The landing control system according to claim 5, wherein said strip is free of contact with said shaft and said cab.

8. The landing control system according to claim 5, wherein said sensor is mounted on an arm cantilevered from said cab and the sensor is provided with a guide member for said strip, said guide comprising a body having a pair of opposed U-shaped slots along its edges in which the longitudinal edge of said strip rides.

9. The landing control system according to claim 6, wherein the guide members are spaced to provide an opening for the sensing head to read said magnetic tape without contact with said magnetic tape.

10. In a multi-storied elevator system, wherein the cab is movable up and down along fixed rails in a vertical shaft and is capable of being selectively stopped at intermediate landings by an electrically operated control system, a landing control system comprising an elongated strip of nonmagnetic material extending substantially from the bottom of the shaft to the top thereof, secured to the face of said strip is a continuous magnet assembly having alternating poles extending the length of said strip, and a plurality of discrete magnetically encoded tapes sequentially spaced along the length of the strip, said landing control system having magnetic sensor means mounted on said elevator cab into spaced proximity with said strip to count said alternating poles and to detect and decode the magnetically encoded tapes as it moves up and down in said shaft, said sensor means providing electrical signals for said elevator control system, said removable encoded tap comprising a plastic tape on which is magnetically located encoded information adhesively attached to said strip.

* * * * *